US005785184A

United States Patent [19]

Metselaar

[11] Patent Number: 5,785,184

[45] Date of Patent: Jul. 28, 1998

[54] STAND WITH HANGERS FOR ITEMS OF CLOTHING

[76] Inventor: Herbert Metselaar, Sonnentaustrasse 5, 88410 Bad Wurzach, Germany

[21] Appl. No.: 737,112

[22] PCT Filed: May 4, 1995

[86] PCT No.: PCT/DE95/00609

§ 371 Date: Nov. 4, 1996

§ 102(e) Date: Nov. 4, 1996

[87] PCT Pub. No.: WO95/30816

PCT Pub. Date: Nov. 16, 1995

[30] Foreign Application Priority Data

May 10, 1994 [DE] Germany ..... 44 16 464.5

[51] Int. Cl.[6] ..... A47F 5/00

[52] U.S. Cl. ..... 211/4; 211/96; 211/168; 70/59; 70/62

[58] Field of Search ..... 211/4, 168, 96, 211/7; 70/59, 62

[56] References Cited

U.S. PATENT DOCUMENTS 3,935,949 2/1976 Cohen ..... 211/96 X
4,088,228 5/1978 Schwalbe ..... 211/4
4,640,420 2/1987 McKay .

FOREIGN PATENT DOCUMENTS 0139276 5/1985 European Pat. Off. .
2230160 12/1974 France .
2668197 4/1992 France .
2152145 10/1971 Germany .
3507162 9/1986 Germany ..... 70/59

*Primary Examiner*—Robert W. Gibson, Jr.
*Attorney, Agent, or Firm*—Spencer & Frank

[57] ABSTRACT

A description is given of a stand (1, 2, 3) with hangers (8, 9) for hanging items of clothing. The hangers (8, 9) have two laterally projecting extension arms (10, 12) and (11, 13), respectively, of which one (12, 13) is passed through the sleeve or the trouser leg of the item of clothing hanging on the hanger. The extension arms (10 to 13) are received rotatably in bearings which are arranged at different levels on the stand (2, 3) and have a common axis (7) which runs alongside the hanging items of clothing. The hangers (8, 9) may be secured against removal by means of a common securing means (14) and a lock (17).

15 Claims, 2 Drawing Sheets

STAND WITH HANGERS FOR ITEMS OF CLOTHING

Figure 1:
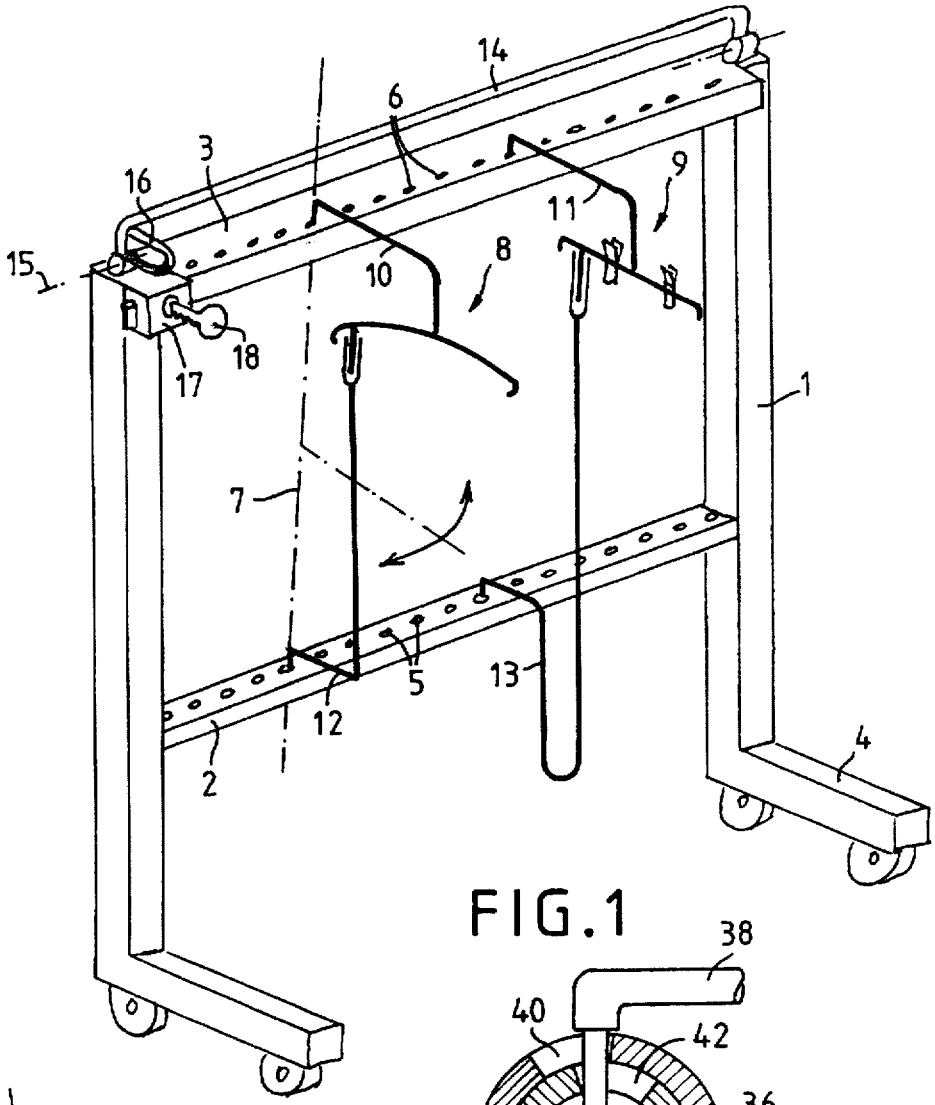

The invention is based on a stand with hangers for items of clothing as is used in textiles retailing, e.g. in clothes shops, for displaying the goods, to be precise, in particular, also outside the shop in the open air, e.g. in pedestrianized areas. In this case, theft prevention is of the utmost importance.

Securing hangers comprising a continuous wire whose two ends are connected to one another by means of a lock, which can be operated by a key, are known. In the open state, such a hanger is placed over the clothes rail and is connected non-releasably to the latter after the lock has been closed. In order to secure on the hanger the item of clothing, e.g. a valuable coat, which is hanging on it, a chain or a cable which cannot be cut is passed, from the hanger, through the sleeve of the item of clothing and back again to the hanger. At its two ends, the cable has eyelets which are fitted over the hanger wire when the hanger is open.

The object of the invention is to propose a system for displaying and storing items of clothing which combines theft prevention with a new method of displaying goods and is simple to use.

This object is achieved by the invention, according to which the clothes hangers have two laterally projecting extension arms which are received rotatably in bearings of the stand at their ends. The bearings preferably have a common axis, with the result that, in contrast to a conventional, centrally suspended hanger, the hanger, with the item of clothing, can be pivoted around the common axis which runs alongside the item of clothing. It is thus possible to "leaf through" the items of clothing similarly to the pages of a book. In this case, the bearing axes are preferably inclined a little towards the observer. The clothes hangers thus assume a stable rest position, with the result that all the items of clothing provided on the stand remain in an ordered arrangement at regular intervals.

As regards theft prevention, it is essential that one of the extension arms can be passed through the sleeve or the trouser leg of the item of clothing in question, and all that is then necessary is to secure the hanger on the stand against removal. This considerably simplifies the use of the stand.

Rather than appearing to the customer first and foremost as a new securing system, such a stand with its hangers gives the impression of being another type of display system. In contrast to equipment which is obviously for the purpose of theft prevention, this has the advantage of providing a friendly atmosphere which encourages the customer to make a purchase.

In order to make it possible to use hangers of different length, it may be expedient for the hanger to have bearings in more than two, in particular three, planes, said bearings having a common axis running through them.

Theft prevention can basically be achieved by the extension arms having bearing journals at their ends, said bearing journals being secured by at least one lock against being pulled out of corresponding bearing openings. Preferably, a common securing means which can be locked by a lock is provided for a plurality of hangers. This may be done by the common movable securing means covering the end sections of the extension arms inserted into the bearing openings. In this case, a swing-action, rotatable or displaceable common flat securing means is conceivable.

A more sophisticated securing means which cannot be seen by the observer can be achieved if the bearing journals are each provided with a head or transverse protrusion which is retained by narrowing the effective receiving opening, with the result that it is no longer possible for the bearing journal to be pulled out.

The stand may be of an elongate design and may be provided with hangers on one or both sides. For the purpose of mounting and securing in each case one row of bearing journals, two concentric tubes which can be rotated one inside the other and have wall openings arranged radially one above the other are advantageously provided on such a stand, it being possible for the clear cross sections of the through-openings to be changed by rotating the tubes. On the other hand, it is also possible for the stand to be designed as a column with bearing openings which are arranged in the form of a ring at different levels. In this case, the same securing principle can be realized by there being provided above or beneath the bearing openings, arranged in a circle, a rotatable disk with associated openings, it being possible for the clear cross sections formed from in each case two openings to be changed by rotating the disk. When the openings are at a wide setting, the bearing journals of the extension arms can be inserted despite the transverse protrusion. Narrowing the opening results in all of them then being secured together and one lock, e.g. an in-built bolt lock or a padlock, is sufficient for the common securing means.

As far as the configuration specifically of the housing is concerned, it is proposed that one extension arm be positioned at the top in the center of the hanger and the other extension arm be positioned at the bottom in the lateral region of the hanger. It is advantageous here if the bottom extension arm is connected to the hanger by a plug-in closure. This means that it is then possible for the item of clothing to be hung, as usual, over the curved part of the hanger and for the straight section of the bottom extension arm then to be inserted through the sleeve from the bottom and connected to the hanger. This facilitates use. The axis of the plug-in closure is preferably positioned parallel to the common axis of the bearing journals. In this case, the bottom extension arm may then remain on the stand after the top extension arm has been removed. Conversely, the plug-in connection parts are joined together virtually simultaneously with the insertion of the top bearing journal into its bearing opening.

In the case of a trouser hanger, it is expedient if the bottom extension arm is bent upwards away from the hanger center axis at its bottom end and, further on, is bent to the side. The so-called curved part (center piece) may also be designed as a straight crossmember and be provided with fastening clips for a pair of trousers. Finally, it is also possible for the extension arms to be provided rotatably, rather than fixedly, on the hanger, in order that the item of clothing can be turned around its center axis, which is also the hanger center axis. For this purpose, one bearing arrangement may be provided above, and one bearing arrangement may be provided beneath, the hanger in the hanger center axis. Lastly, an advantageous embodiment of the hanger consists in the latter being made up of a top part, for example for a jacket, and of a bottom part, for example for a pair of trousers, to be precise likewise with the aid of a plug-in closure. The possibility of plugging various hanger parts together reduces the number of these parts which have to be kept in stock and increases the possible applications of the system.

In addition to being used for outdoor sales in textile retailing, the stand and the hangers described may also be used as an in-built storage system. Furthermore, they may be used for wardrobe-securing purposes in restaurants, cultural centers, schools, sports complexes, etc.

Figure 6:
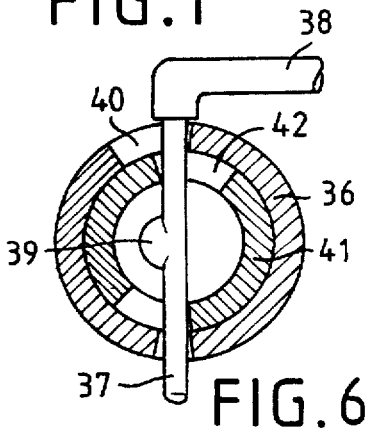
Figure 2:
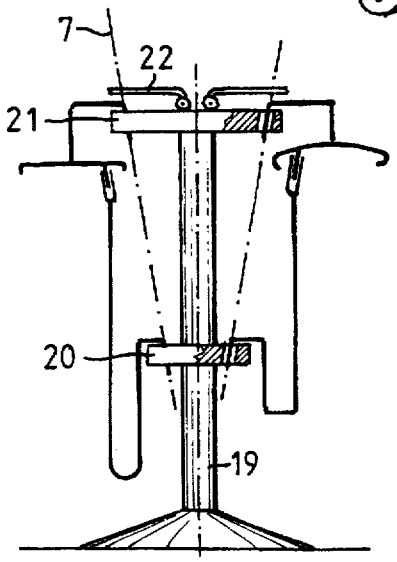
Figure 7:
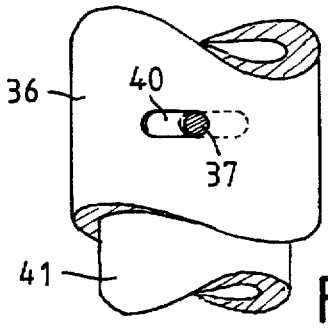
Figure 5:
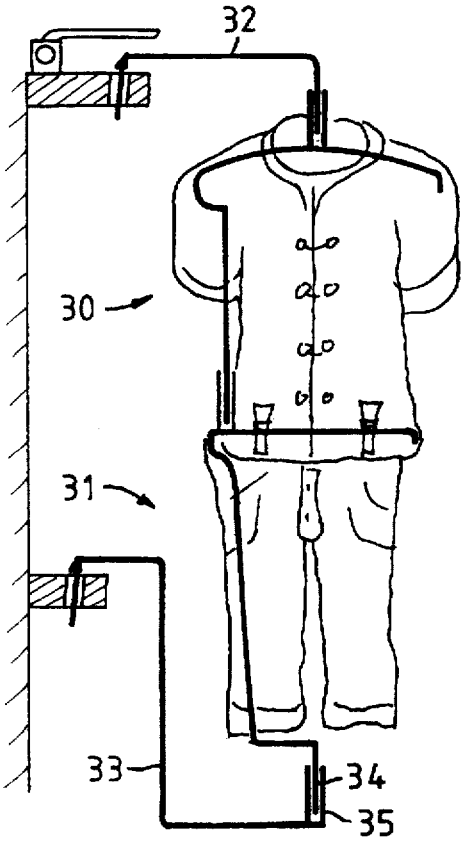
Figure 3:
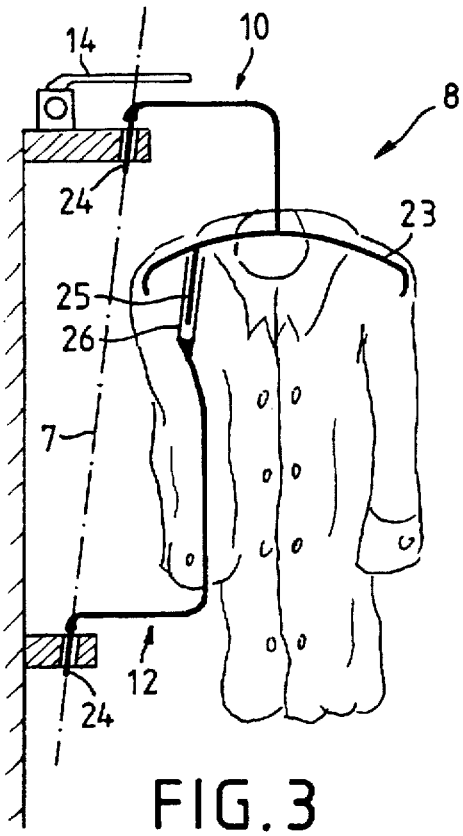
Figure 4:
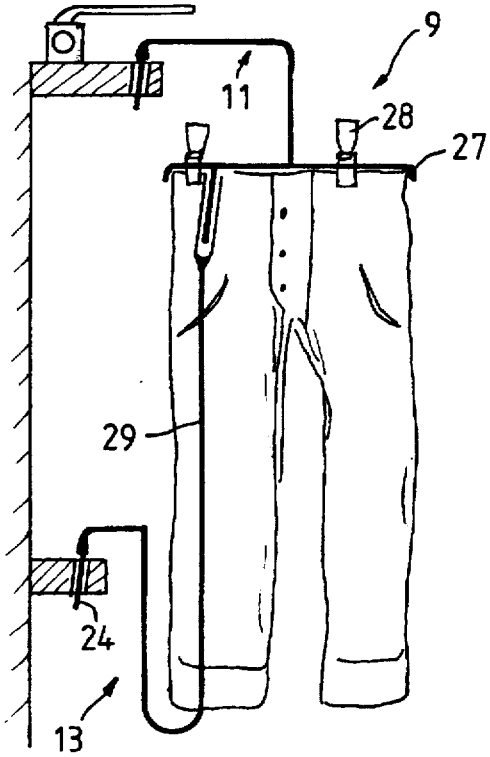

Exemplary embodiments of the invention are explained hereinbelow with reference to the drawing, in which, in detail:

FIG. 1 shows a three-dimensional view of an elongate clothes stand with two hangers fitted in it, FIG. 2 shows, on a smaller scale, the view of a column-like clothes stand with said hangers, FIG. 3 shows a view of one hanger according to FIG. 1 with a coat hanging on it, FIG. 4 shows a view of the other hanger according to FIG. 1 with a pair of trousers hanging on it, FIG. 5 shows a view of the other hanger for a matching set comprising jacket and trousers, the extension arms being arranged rotatably, FIG. 6 shows a cross-section of a carrying tube with common securing means, and FIG. 7 shows the plan view of a section of the carrying tube according to FIG. 6.

The clothes extension in FIG. 1 comprises two L-shaped end pieces whose vertical legs 1 are connected to one another by a bottom horizontal crossmember 2 and a top horizontal crossmember 3. In each case two running rollers are arranged on the shorter, horizontal leg 4 of the end pieces. The stand is designed for hanging a row of hangers whose weight is distributed approximately uniformly over the four rollers. Alternatively, the stand could also be designed for two parallel rows of hangers, for which purpose the end pieces are then expediently designed in the form of a T.

The two horizontal crossmembers 2 and 3 each have a row of bearing openings 5 and 6, respectively, pairs of which have common axes, specifically the axes 7 are not precisely vertical, but rather are inclined towards the side of the horizontal legs 4 of the end pieces.

The clothes hangers 8 and 9, which will be discussed in more detail hereinbelow, each have a top extension arm 10 or 11, respectively, and a bottom extension arm 12 or 13, respectively. Their ends are angled downwards by almost 90°, and these end pieces are fitted into in each case two associated bearing openings 5 and 6. It is thus possible for the clothes hangers 8 and 9 to be pivoted around their axis 7 in each case.

In order to prevent the possibility of removing the hangers from the stand, a securing bracket 14 is provided, and this is mounted, by means of its bent-over ends, on the top crossmember 3, in the vicinity of the ends thereof, such that it can be pivoted around an axis 15 parallel to the crossmember. Arranged on the securing bracket 14 is a closure eyelet 16 which interacts with a lock 17 which is fastened on the stand, to be precise such that it is possible for the securing bracket 14, which is swung down onto the top extension arms 10, 11 of the clothes hangers, to be locked in this position by means of a key 18, with the result that said extension arms cannot be moved upwards.

This figure also makes it clear that, by virtue of the slight inclination of the axes 7, the clothes hangers swing around these axes (as is indicated by the arrow depicted) and thus all position themselves in planes perpendicular to the crossmembers, with the result that the clothes stand always gives an ordered impression.

The clothes stand illustrated in FIG. 2 have a central column 19 which is retained by a foot. Approximately half way up and at the top, the column has two horizontal round discs 20 and 21 which each have a ring of bearing openings. The respectively associated bearing openings of the bottom and top discs have a common axis 7 which is inclined outwards away from the column, with the result that, in this case, the clothes hangers fitted in them position themselves in radially arranged planes. As a result of this inclination, the top disc 21 has a larger diameter. In order to prevent the hangers from being removed, two semicircular swing-action securing brackets 22 are provided, and these are positioned over the top extension arms of the brackets without, however, obstructing the pivot movement thereof.

The clothes hanger 8 according to FIG. 1 will be described in more detail with reference to FIG. 3, said clothes hanger 8 forming a preferred embodiment of a hanger according to the invention for coats, jackets, T-shirts, etc. The hanger has a curved center piece 23 on which the shoulders of the item of clothing rest. The extension arm 10 is positioned, with an upwardly directed section, at the top, symmetrically in the center, and is then bent horizontally to the left and, which section at the end, is bent, once again, downwards, the last bent portion being designed as bearing journal 24. On the left-hand half of the center piece 23, a plug-shank 25 projects downwards in a slightly oblique manner. Along with the corresponding receiving bushing 26 at the top end of a vertical section of the bottom extension arm 12, it forms a non-rotatable, spring-action plug-in connection which can be secured against being forced apart. The inclination of said plug-in connection 25, 26 is selected such that its longitudinal axis runs parallel to the axis 7 of the hanger. At the bottom, the bottom extension arm also passes into a horizontal section which is oriented towards the left-hand side and likewise bears a bearing journal 24 at the end.

This clothes hanger 8 is intended to be used as follows: the center piece 23 with the top extension arm 10 can be removed; the bottom extension arm 12 remains on the clothes stand. When restocking the hanger, the item of clothing is, as usual, hung over the center piece 23. Then, the vertical part of the bottom extension arm 12 is passed into the sleeve and the plug-in shank 25 is inserted some way into the receiving bushing 26, in a position which is oblique with respect to the hanger plane. Then, the top part of the hanger is rotated into the hanger plane and the plug-in connection is thus secured against being pulled apart. The top bearing journal 24 is then fitted in. In this case, the plug-in shank 25, which has an additional displacement distance in the receiving bushing 26, also moves further into the latter. Removal or restocking is thus simplified. Finally, the top bearing journals 24 are then secured against removal by means of the securing bracket 14.

FIG. 4 shows the clothes hanger 9 according to FIG. 1, which is specifically designed as a trouser hanger. Its center piece 27 is, rather, straight and bears two clips 28, with the aid of which a pair of trousers can be hung by the waistband. In this case, the vertical section 29 of the bottom extension arm 13 is at least as long as a trouser leg. It is passed through the latter and, at the bottom, is bent upwards again at a distance parallel to itself. The trousers can thus hang freely. In the same way as on the other extension arms, the bearing journal 24 follows after a short horizontal section.

The clothes hanger according to FIG. 5 has two special features: it is envisaged for two items of clothing, which form a matching set, and it can rotate freely around the hanger center axis with respect to the extension arms. The clothes hanger thus comprises four separate parts, namely a top hanger 30, a bottom hanger 31 and the two rotatable extension arms 32 and 33. The top hanger 30 has a curved center piece, as usual, and a vertically downwardly directed section on one side. Said section forms a plug-in shank for an upwardly oriented receiving bushing of the bottom hanger 31, which is a trouser hanger. Likewise arranged on the straight, clip-containing center piece of the latter is an end-side vertically downwardly oriented section, which is bent over at the bottom towards the hanger center axis. This section bears a downwardly oriented bearing journal 34 which is arranged on the axis and interacts with the bearing bushing 35 on the extension arm 33. Correspondingly, an upwardly directed bearing bushing is arranged, on the center axis, on the center piece of the top hanger 30. This bearing bushing interacts with a corresponding bearing journal on the extension arms 32. Since the vertical sections of the top hanger 30 and of the bottom hanger 31 are fitted through the sleeve and one trouser leg respectively, the two matching items of clothing cannot be removed from the hangers. The two bearing arrangements are coaxial and allow the hanger combination to turn around its center axis with respect to the two extension arms 32, 33, which, as in the case of the other clothes hangers, can be pivoted around their common bearing axis 7.

FIG. 6 and 7 show a variant of a common means for securing a plurality of extension-arm bearing journals against being removed from their bearing openings. Accordingly, in the case of an elongate clothes stand, a carrying tube 36 is provided instead of at least one of the two horizontal crossmembers 2 and 3 (according to FIG. 1). Said carrying tube has a number of openings in each case at the top and bottom for a bearing journal 37 of an extension arm 38. In the center, the bearing journal has a stud-like transverse protrusion 39. The top opening 40 in the carrying tube is thus of elongate design in the circumferential direction, with the result that the protrusion passes through. A securing tube 41 is arranged rotatably in the carrying tube 36. Said securing tube likewise has two mutually opposite slot-like openings 42, which are arranged such that, when the bearing journal 37 has been fitted in, the securing tube can be rotated through a certain angle. In the closure position shown, the bearing journal cannot be pulled out because its transverse protrusion 39 strikes against the securing tube 41. On the other hand, when the securing tube is rotated to the left, the openings 40 and 42 coincide, with the result that the bearing journal, with its transverse protrusion 39, can be lifted out without obstruction. The securing tube 41 is arrested in the blocking angled position at one end by means of a lock. Such a lock, as described earlier, may also be provided in the construction shown in FIG. 2. For example, above or beneath the disc 21 (carrying the bearing openings) there may be provided a rotatable disc with associated openings and thus the clear (that is, overlapping) cross sections formed by an opening in the disc 21 and an opening in the rotatable disc may be changed by rotating the disc relative to the disc 21.

I claim:

1. A stand with hangers for items of clothing, wherein the hangers (8) have two laterally projecting extension arms (10, 12), of which one is passed through the sleeve or the trouser leg of the item of clothing hanging on the hanger, and wherein the extension arms (10, 12) are received rotatably in bearing which are arranged at different levels on the stand and have a common axis (7) which runs alongside the item of clothing.

2. The stand as claimed in claim 1, wherein the common axis is inclined towards the observer with respect to a vertical position.

3. The stand with hangers as claimed in claim 1, wherein the extension arms (10, 12) have bearing journals (24) at their ends, said journals being secured by at least one lock (17) against being pulled out of corresponding bearing openings (5,6).

4. The stand with hangers as claimed in claim 3, wherein a common securing means (14) which can be locked by a lock (17) is provided for a plurality of hangers.

5. The stand with hangers as claimed in claim 4, wherein said extension arms have end sections and further wherein the common securing means (14) is movable and covers the end sections of the extension arms (10, 11) inserted into the bearing openings.

6. The stand with hangers as claimed in claim 3, wherein the bearing journals (37) are each provided with one of a head and a transverse protrusion (39).

7. The stand with hangers as claimed in claim 1, wherein the stand (1 to 4) is of elongate design and is provided with hangers (8, 9) on at least one side.

8. The stand with hangers as claimed in claim 1, wherein the stand is designed as a column (19) with bearing openings which are arranged in the form of a ring at different levels.

9. The hanger as claimed in claim 1, wherein one extension arm (10) is positioned at the top in the center of the hanger and the other extension arm (12) is positioned at the bottom in the lateral region of the hanger.

10. The hanger as claimed in claim 9, wherein the bottom extension arm (12) is connected to the hanger by a plug-in closure (25, 26).

11. The hanger as claimed in claim 10, wherein the center longitudinal axis of the plug-in closure (25, 26) runs parallel to the axis (7) of the hanger.

12. The hanger as claimed in claim 9, wherein the bottom extension arm (13) is bent upwards away from the hanger center axis at its bottom end and, further on, is bent to the side.

13. The hanger as claimed in claim 1, wherein the extension arms (32, 33) can be rotated with respect to the hanger by means of two bearing arrangements (34, 35) arranged in the hanger center axis, above and beneath the hanger.

14. The stand with hangers as claimed in claim 1, further comprising (a) bearing journals attached to said extension arms and having transverse protrusions; said bearing journals being received by said bearing openings;

(b) first supporting means for carrying a first series of said bearing openings; and (c) second supporting means for carrying a second series of said bearing openings; said first supporting means adjoining said second supporting means; respective said bearing openings of said first series forming pairs with respective said bearing openings of said second series; said first and second supporting means being movable relative to one another into first and second positions to vary an extent of overlap of said bearing openings of said first series relative to said bearing openings of said second series; in said first position said overlap being sufficiently large to allow passage of respective said transverse protrusions and in said second position said overlap being sufficiently narrow to prevent passage of respective said transverse protrusions, whereby said bearing journals are held captive in said bearing openings.

15. The stand with hangers as claimed in claim 1, further comprising (a) bearing journals attached to said extension arms and having transverse protrusions;

(b) a carrying tube having a plurality of first wall openings arranged diametrically in pairs; and (c) a securing tube arranged coaxially within said carrying tube and having a plurality of second wall openings arranged diametrically in pairs; said first and second wall openings constituting said bearing openings for receiving said bearing journals; said carrying tube and said securing tube being rotatable relative to one another into first and second rotary positions to vary an extent of overlap of said first wall openings relative to said second wall openings; in said first rotary position said overlap being sufficiently large to allow passage of respective said transverse protrusions and in said second rotary position said overlap being sufficiently narrow to prevent passage of respective said transverse protrusions, whereby said bearing journals are held captive in said bearing openings.

* * * * *